US008783824B2

(12) United States Patent
Ishimatsu et al.

(10) Patent No.: US 8,783,824 B2
(45) Date of Patent: Jul. 22, 2014

(54) CAPPING UNIT FOR INK JET RECORDING UNIT

(75) Inventors: Shin Ishimatsu, Fuchu (JP); Kenji Kitabatake, Kawasaki (JP); Yutaka Koizumi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 830 days.

(21) Appl. No.: 12/234,171

(22) Filed: Sep. 19, 2008

(65) Prior Publication Data

US 2009/0085964 A1 Apr. 2, 2009

(30) Foreign Application Priority Data

Sep. 27, 2007 (JP) ..... 2007-251887
Aug. 27, 2008 (JP) ..... 2008-218458

(51) Int. Cl.
*B41J 2/165* (2006.01)

(52) U.S. Cl.
CPC ..... *B41J 2/16505* (2013.01)
USPC ..... 347/31

(58) Field of Classification Search
USPC ..... 347/31, 29
See application file for complete search history.

(56) References Cited

U.S. PATENT DOCUMENTS

| | | | | |
|---|---|---|---|---|
| 5,682,186 | A * | 10/1997 | Bohorquez et al. | 347/29 |
| 5,956,054 | A * | 9/1999 | Hirabayashi et al. | 347/37 |
| 6,273,546 | B1 * | 8/2001 | Kobayashi et al. | 347/29 |
| 6,805,437 | B2 | 10/2004 | Yamanaka et al. | |
| 6,896,352 | B2 * | 5/2005 | Miyauchi | 347/30 |
| 6,945,643 | B2 * | 9/2005 | Tajima et al. | 347/87 |
| 2002/0024551 | A1 * | 2/2002 | Saito | 347/30 |
| 2002/0101471 | A1 * | 8/2002 | Shigeno | 347/24 |
| 2004/0041877 | A1 * | 3/2004 | Shigeno et al. | 347/29 |
| 2006/0221119 | A1 * | 10/2006 | Bertelsen et al. | 347/29 |
| 2007/0126778 | A1 * | 6/2007 | Ha | 347/29 |
| 2009/0085964 | A1 * | 4/2009 | Ishimatsu et al. | 347/31 |

FOREIGN PATENT DOCUMENTS

| | | | | |
|---|---|---|---|---|
| JP | 05008405 | A * | 1/1993 | |
| JP | 2004-262035 | | 9/2004 | |
| JP | 2005288967 | A * | 10/2005 | B41J 2/165 |

OTHER PUBLICATIONS

INPIT Machine Translation of Seshimo 2005-288967 Japanese Patent Publication Reference.*

* cited by examiner

*Primary Examiner* — Mark Robinson
*Assistant Examiner* — Andrew Jordan
(74) *Attorney, Agent, or Firm* — Fitzpatrick, Cella, Harper & Scinto

(57) ABSTRACT

A capping unit is detachably mountable to an ink jet recording head. The ink jet recording head has an ejection outlet surface provided with ejection outlets for ejecting ink. The capping unit includes: a liquid-absorbing member provided with a projection contactable to a periphery of an area, in which the ejection outlets are formed, on the ejection outlet surface so as to form a gap between the area and the liquid-absorbing chamber; and a capping member including an engaging portion and an elastic portion for contacting a rear surface opposite from a surface on which the projection of said liquid-absorbing member is formed to press said liquid-absorbing member against the ejection outlet surface.

11 Claims, 8 Drawing Sheets

CAPPING UNIT FOR INK JET RECORDING UNIT

FIELD OF THE INVENTION AND RELATED ART

The present invention relates to a capping unit for protecting, during distribution, an ink jet recording head for effecting recording by ejecting a recording head from ejection outlets.

As an example of a structure of a recording apparatus using an ink jet technology, a recording apparatus disclosed in U.S. Pat. No. 6,805,437 has been known.

In the recording apparatus disclosed in U.S. Pat. No. 6,805,437, ink is supplied from a main container to an ink jet recording head by a so-called tube supply method. This recording head includes a recording element substrate provided with nozzles (constituted by ejection outlets and flow passages communicating with the ejection outlets) for ejecting the ink, an ink retaining space, and an ink introducing port. Further, in order not to cause ejection defect due to an abrupt change in pressure and leakage of ink from the ejection outlets and the ink introducing port, buffer portions such as an ink retaining portion for secondary-retaining the ink between an ink container and the ink retaining portion and a filter are integrally provided, thus constituting the recording head as a whole. Such a recording head is not mounted in a printer until the printer is set, thus being subjected to (physical) distribution alone.

In the case where the recording head is subjected to distribution alone, when an inside of a nozzle is in a dry state during distribution, a state in which wettability of an inner surface of the nozzle with respect to the ink is different from originally intended wettability, i.e., a non-uniform state of the wettability of the inner surface of the nozzle with respect to the ink is brought about. Due to such non-uniform wettability with respect to the ink, ejection defect can occur.

Therefore, during distribution of the recording head, transparent ink (distribution ink) containing no colorant is contained in the nozzle. The inside of the recording head (the nozzle) is placed in a wet state by the distribution ink, so that even when the recording head is mounted in the printer immediately after the distribution to execute recording, the wettability of the inner surface of the nozzle with respect to the ink is kept in the originally intended state. For that reason, such a disadvantage caused in the case of the distribution of the recording head in the dry state is eliminated.

However, the recording head in which the present invention is contained is increased in inner head pressure in some cases by an ambient condition change or the like in a storage process from production to product shipment or a distribution process from the shipment to delivery to a user. In such cases, there is a possibility of leakage of the distribution ink from the ejection outlets or the ink introducing port.

In order to prevent the ink from leaking cut of the ejection outlets, there is a method in which the ejection outlets are hermetically sealed by directly pressing a tape, a rubber material, or the like against the recording element substrate in which the ejection outlets are formed. In this case, it is necessary to press the tape or the rubber material against the recording element substrate with a strong pressure in order to prevent the ink leakage. However, when the recording element substrate is pressed under such a strong pressure, there is a possibility of an occurrence of deformation or the like in an area, in which the ejection outlets are formed, of the recording element substrate. Further, dust or contaminant can enter between the recording element substrate and the tape or the rubber material, so that there is a possibility of clogging of the ejection outlets with heat dust or contaminant. In addition, an adhesive on the tape surface is transferred onto the recording element substrate, so that there is a possibility of a change in wettability of the recording element substrate with respect to the ink or a possibility of an occurrence of damage on the recording element substrate.

In order to eliminate these possibilities, U.S. Pat. No. 6,945,643 discloses a capping unit which is to be mounted to a recording head containing distribution ink therein and is provided with a planar liquid-absorbing member in an elastic cap formed of an elastic member. By a constitution in which this capping unit is attached to the recording head, it became possible to realize a form of distribution capable of protecting a nozzle portion in a non-contact state with an area in which ejection outlets are formed (the nozzle portion). This constitution has been conventionally employed frequently.

Incidentally, in the above-described form of distribution, the shape of the liquid-absorbing member accommodated in the elastic cap was a planar plate-like shape. Therefore, when the capping unit is attached to an ejection outlet surface (at which a recording element substrate is provided) of the recording head provided with the ejection outlets, there is a large spacing between a surface of the liquid-absorbing member and the ejection outlets of the recording head. When such a large spacing is present, distribution ink is leaked from the ejection outlets, e.g., in the case where the recording head falls or in the case where the recording head is placed in a high-temperature environment to expand the air in the recording head. The leaked distribution ink itself becomes a large droplet to be deposited on the ejection outlet surface. When the capping unit is removed in this state, the droplet of the distribution ink deposited on the ejection outlet surface drips, so that there is possibility of contamination of user's hand or clothes, a work-bench, or the like with the dripped distribution ink.

As a countermeasure thereof, e.g., Japanese Laid-Open Patent Application (JP-A) 2004-262035 proposes a constitution in which a stepped portion is provided to a liquid-absorbing member so that the liquid-absorbing member does not contact an ejection outlet-formed area in which ejection outlets are formed but can contact an area other than the ejection outlet-formed area. By decreasing the stepped portion provided to the liquid-absorbing member, it is possible to decrease the spacing between the ejection outlet-formed area and the liquid-absorbing member, so that the distribution ink can be absorbed by the liquid-absorbing member before it becomes a large droplet and thus the above-described disadvantages can be eliminated.

In the constitution described in JP-A 2004-262035, it is important to control the spacing between the liquid-absorbing member and the ejection outlet-formed area with high accuracy. When the spacing is excessively large, the distribution ink grows into the large droplet as described above, so that the droplet of the distribution ink drips when the capping unit is removed. On the other hand, when the spacing is excessively small, due to impact during recording head falling, the ejection outlet-formed area and the liquid-absorbing member contact each other. For that reason, it is necessary that a dimension of the liquid-absorbing member is strictly regulated, that an impact-absorbing material (rubber material) is used, and that a complicated structure is formed, so that there arose problems in terms of design latitude, ecology, and cost.

In recent years, high-definition and high-speed printing is desired, so that a recording head is increased in size. In the recording head increased in size, impact in the case where the recording head falls is also large. In the case where the liquid-absorbing member contacts the ejection outlet-formed area due to the impact during the recording head falling, there is a possibility of an occurrence of damage such as deformation of the ejection outlets. Further, in the case where the liquid-absorbing member contacts a portion of the ejection outlet surface other than the ejection outlet-formed area so that the liquid-absorbing member does not contact the ejection outlet-formed area, there is a possibility of an occurrence of damage of the ejection outlet surface by the falling impact.

In order to alleviate such impact during the falling of the recording head, it is possible to employ a method in which a large amount of a cushioning member is put in the capping unit or the recording head is put in a strict packing material but the method involves a problem of an increase in cost, so that an increase in packing member is undesirable also from an ecological viewpoint.

SUMMARY OF THE INVENTION

The present invention has accomplished in view of the above-described problems. A principal object of the present invention is to provide a capping unit capable of reducing impact on the ejection outlet surface of an ink jet recording head while keeping reliability concerning prevention of ink leakage or the like from the ink jet recording head in a form of distribution.

Another object of the present invention is to provide a capping unit which can be easily disassembled and reused.

A further object of the present invention is to provide an ink jet recording head to which the above-described capping unit is mounted.

According to an aspect of the present invention, there is provided a capping unit detachably mountable to an ink jet recording head, the ink jet recording head having an ejection outlet surface provided with ejection outlets for ejecting ink, the capping unit comprising:

a liquid-absorbing member provided with a projection contactable to a periphery of an area, in which the ejection outlets are formed, on the ejection outlet surface so as to form a gap between the area and the liquid-absorbing chamber; and a capping member comprising an engaging portion and an elastic portion for contacting a rear surface opposite from a surface on which the projection of the liquid-absorbing member is formed to press the liquid-absorbing member against the ejection outlet surface.

By employing such a constitution, even in the case where a recording head accidentally falls so as to have impact on an ejection outlet-formed surface provided with ejection outlets, the elastic portion is elastically deformed to alleviate the impact.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A constitution of a capping unit to which the present invention is applied will be described with reference to the drawings.

Figure 1:
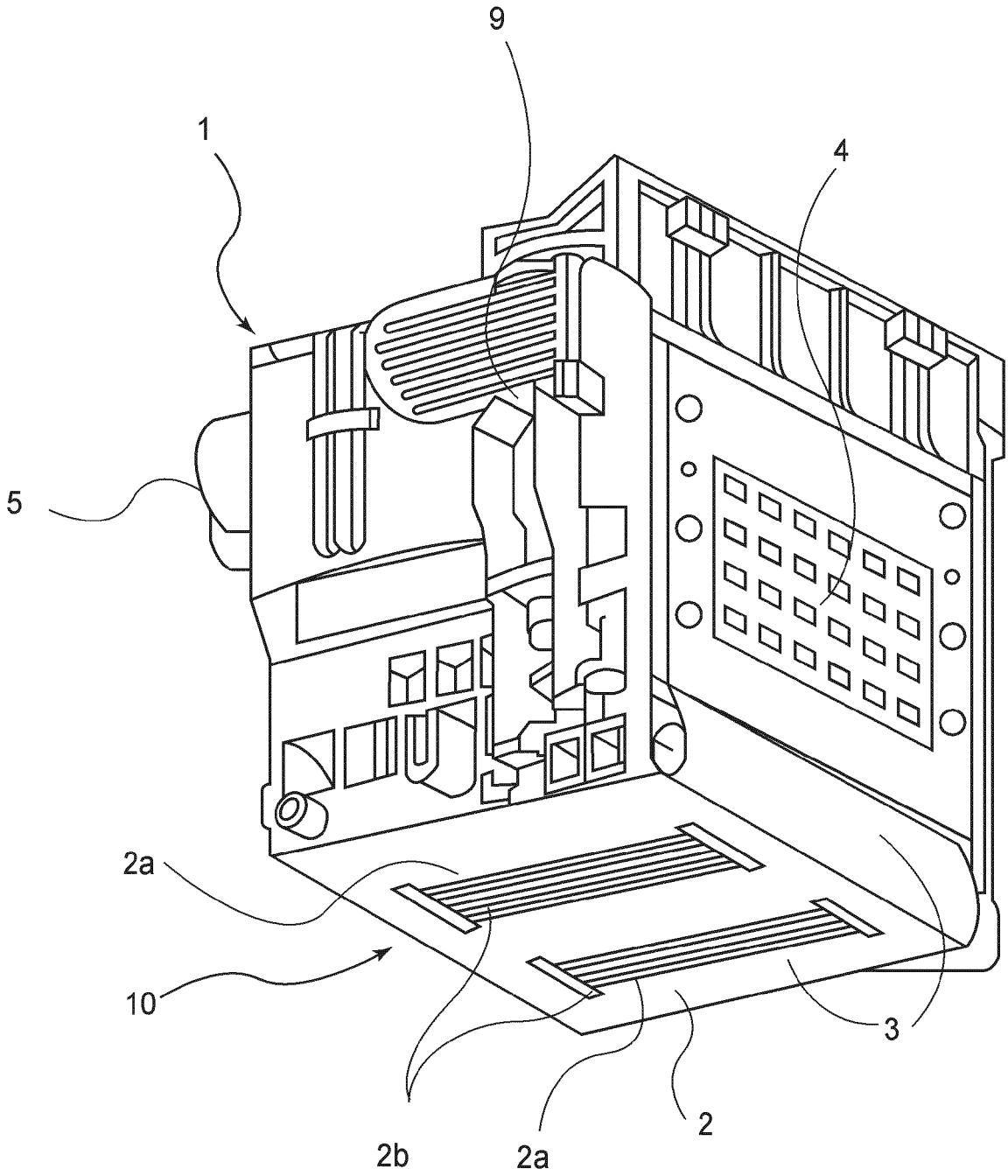
FIG. 1 is a schematic perspective view showing an ink jet recording head.

FIG. 1 is a perspective view schematically showing an ink jet recording head 1 to which the capping unit according to the present invention is to be mounted. Referring to FIG. 1, the recording head 1 includes an ejection outlet surface 2 provided with ejection outlets 2*b* for ejecting ink, a recording element substrate 2*a* on which the ejection outlets 2*b* and a recording element (not shown) for ejecting ink from the ejection outlets 2*b* are formed, a connecting contact 4 for electrically connecting the recording head 1 to an ink jet recording apparatus, an electric wiring tape 3 for electrically connecting the recording element substrate 2*a* and the connecting contact 4, and an ink injection port 5 into which an ink supply tube (not shown) for supplying ink from an ink container (not shown) is to be inserted and connected. The ink supplied from the ink supply tube inserted into the ink injection port 5 is retained in an inside space of the recording head 1 and supplied to the recording element substrate 2*a*. A recording signal is transmitted from the recording apparatus to the recording element formed on the recording element substrate 2*a* through the connecting contact 4 and the electric wiring tape 3, so that the recording element is driven in accordance with the recording signal to eject the ink from the ejection outlets 2*b* to effect recording. As a constitution of the recording head 1, it is possible to use a constitution described, e.g., U.S. Pat. No. 6,945,643.

This recording head 1 contains and retains distribution ink (liquid) in an inside space during distribution, so that wettability with respect to ink in an area from the inside space to the ejection outlets is kept at a uniform level.

Figure 6:
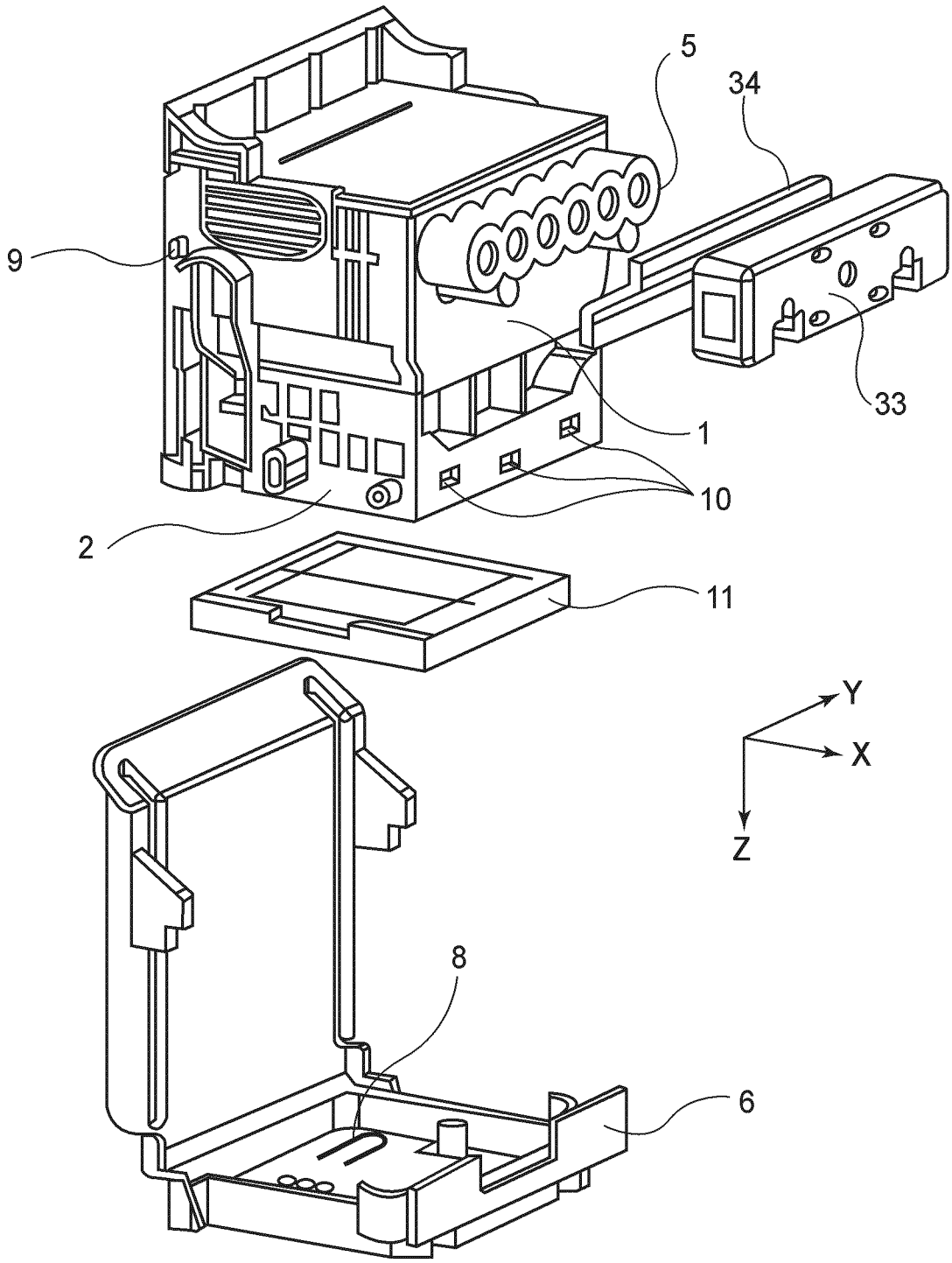
FIG. 6 is a schematic perspective view showing the recording head, the liquid-absorbing member, and the cap.

As an engaging structure for attaching a capping unit for protecting the recording head during distribution to the recording head, a first hooking portion 9 provided on both side surfaces of the recording head 1 and a second hooking portion 10 is provided in the neighborhood of the ejection outlet-formed surface, on a side surface at which the ink injection port 5 is provided (as specifically shown in FIG. 6).

Figure 2:
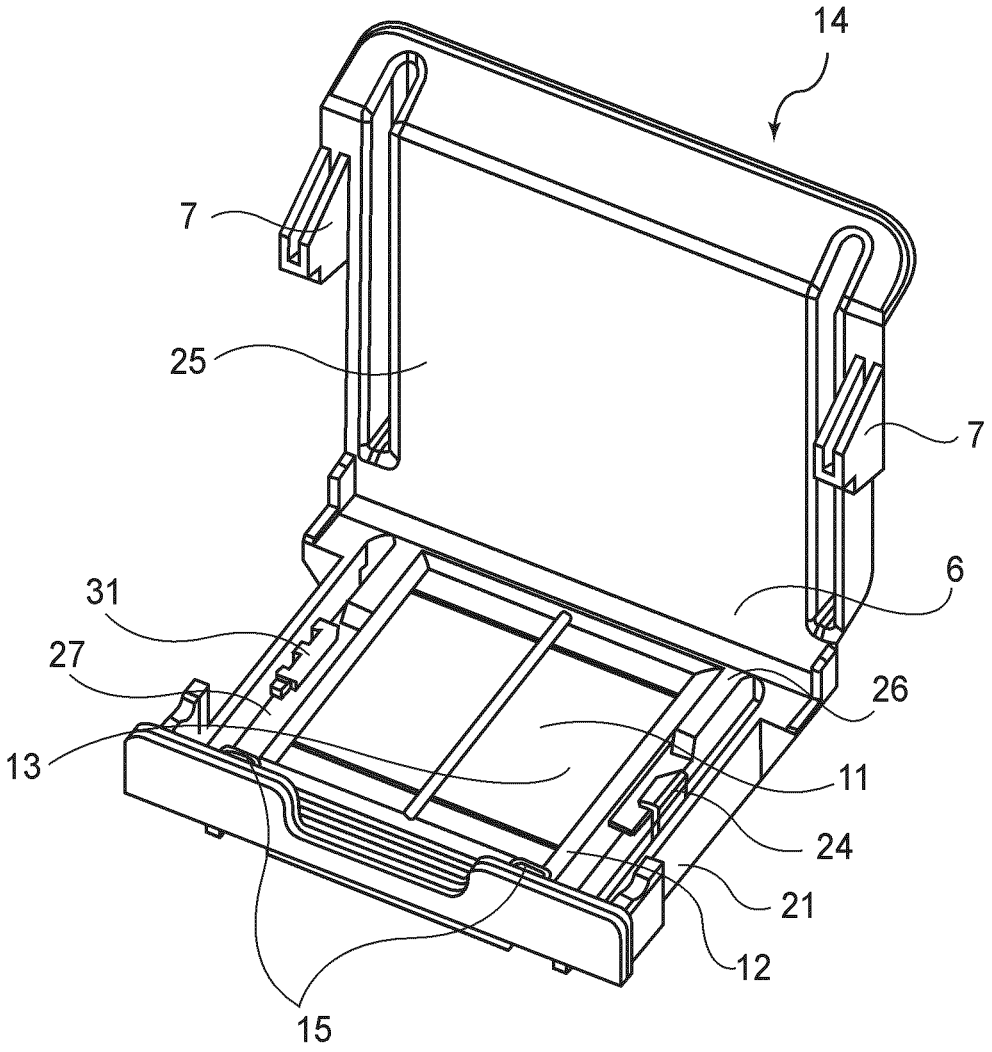
FIG. 2 is a schematic perspective view showing a capping unit.

FIG. 2 is a schematic perspective view showing a first constitutional example of a capping unit 14 to which the present invention is applied, wherein the capping unit 14 includes a capping member 6 and a liquid-absorbing member 11. The capping member 6 includes, as a principal side surface, a side surface 21 configured to oppose the ejection outlet surface 2 of the recording head 1 and a side surface 25 configured to oppose a side surface of the recording head 1 provided with the connecting contact 4. The capping member 6 is a structure which is integrally constituted so that the two side surfaces 21 and 25 are perpendicular to each other to provide a substantially L-shape cross-section. The side surface 25 configured to oppose the side surface of the recording head 1 provided with the connecting contact 4 is provided with a third engaging portion 7 to be engaged with the first hooking portion 9 of the recording head 1. The side surface 25 functions as a connecting contact protecting portion for protecting the connecting contact 4.

The liquid-absorbing member 11 is mounted on the side surface 21 of the capping member 6 configured to oppose the ejection outlet surface 2 of the recording head 1 and is placed in a state in which the liquid-absorbing member 11 is engaged with a first engaging portion 24 and a second engaging portion 31 provided to the capping member 6. The liquid-absorbing member 11 is provided with a recess 13 as a first area configured to oppose an area of the ejection outlet surface 2 in which the ejection outlets 2*b* are formed (i.e., the recording element substrate 2*a* in the present invention) and a projection 12 as a second area which is a peripheral portion of the first area and is configured to contact the ejection outlet surface 2.

Figure 3:
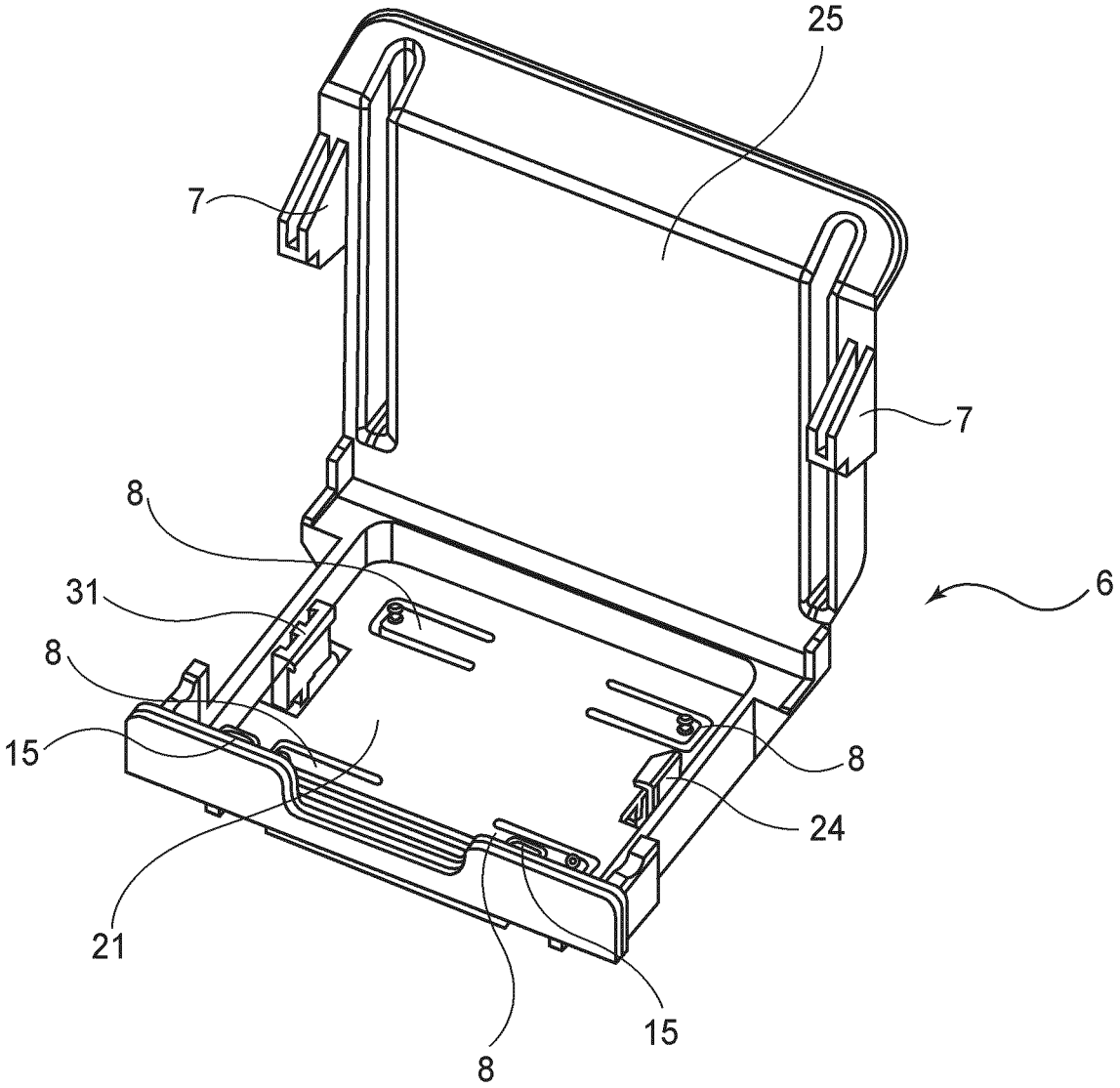
FIG. 3 is a schematic perspective view showing a cap constituting the capping unit.
Figure 4:
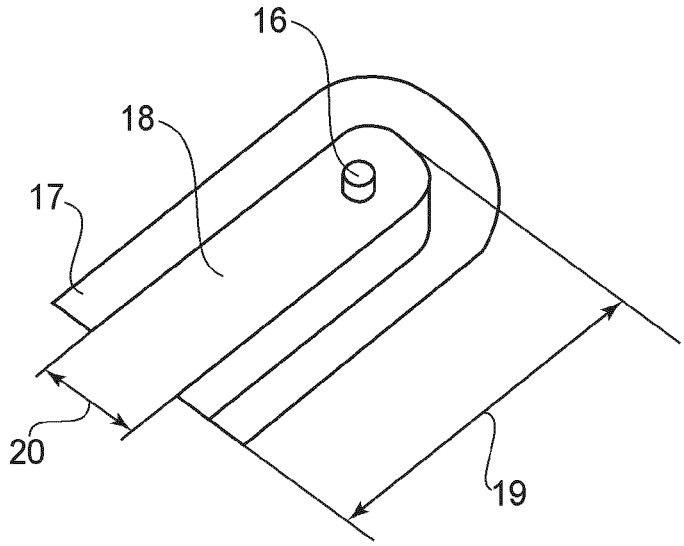
FIG. 4 is an enlarged view showing an elastic structure provided to the cap.

FIG. 3 is a schematic perspective view showing a constitution of the capping member 6 alone after the liquid-absorbing member 11 is removed from the constitution of the capping unit 14 shown in FIG. 2. The side surface 21 on which the liquid-absorbing member 11 is mounted is provided with an elastic structure 8 as an elastic portion. At four positions spaced equidistantly from a center of the side surface 21 toward four corners of the side surface 21, the elastic structure 8 and an application point contactable to the liquid-absorbing member 11 (a projected portion 16 described later) are located. The elastic structure 8 is constituted by the side surface and an example thereof is shown in FIG. 4, wherein the elastic structure 8 is principally constituted by a plate-like portion 18 located inside a cut portion such as a U-shaped slit 17 or the like formed in the side surface 21. At an end portion of the plate-like portion 18, the projected portion 16 integrally formed with the elastic structure 8 so as to support the liquid-absorbing member 11 in contact with a rear surface (opposite from the ejection outlet surface 2) of the liquid-absorbing member 11 in a state in which the liquid-absorbing member 11 (FIG. 5A to 5C) is mounted on the capping member 6. The elastic structure 8 is constituted by the plate-like portion 18 and the projected portion 16. As shown in FIG. 4, the plate-like portion 18 has a length 19 and a width 20.

Displacement of the plate-like portion 18 can be adjusted by a height of the projected portion 16 and an elastic displacement area and an elastic force of the plate-like portion 18 as an elastic member can be adjusted by the length 19, the width 20, a thickness, and the like of the plate-like portion 18. The elastic displacement area or the elastic force of the plate-like portion 18 is affected by a constituent material of the capping member 6 constituting the plate-like portion 18, so that it is necessary to select a proper material. Further, the displacement adjustable by the height of the projected portion 16 is required to be within the elastic displacement area so that plastic deformation is less liable to occur. In the case where the elastic force, the elastic displacement area, the number of elastic structure 8, and an arrangement of the projected portion 16 as the application point are improper, not only a sufficient impact absorbing effect cannot be achieved but also it is difficult to mount the capping member 6 to the recording head 1 in some cases.

In a first embodiment, the plate-like portion 18 had a length 19 of 12 mm, a width 20 of 4 mm, and a thickness of 1.5 mm, and the projected portion 16 had a height of 2 mm. The capping member 6 was formed of polypropylene and an elastic structure 8 having a spring constant of 3.5±0.3 N/mm was provided at four positions on the side surface 21 of the capping member 6 configured to oppose the ejection outlet surface 2.

The elastic structure 8 formed of a resinous member (including polypropylene) can cause a creep phenomenon depending on an environment or a structure, so that the elastic structure 8 is inferior in persistence of elasticity to an elastic structure 8 formed of metal. However, in the case of using the elastic structure 8 for the capping member 6 during distribution in a limited period, the elastic structure 8 is not placed in an environment in which impact is repeatedly exerted no the elastic structure 8 more than necessary and the elastic structure 8 is not subjected to demounting at frequent intervals, thus being particularly of no problem.

As shown in FIG. 3, the capping member 6 is provided with the first engaging portion 24 and the second engaging portion 31 on the side surface 21. When the liquid-absorbing member 11 is mounted on the side surface 21 of the capping member 6, the first and second engaging portions 24 and 31 holds the liquid-absorbing member 11 on the capping member 6 in interrelation with the elastic structure 8. The capping member 6 is also provided with an engaging structure detachably mountably to the recording head 1, so that a third engaging portion 7 is engageable with the hooking portion 9 (FIGS. 1 and 6) and a fourth engaging portion 15 is engageable with the hooking portion 10 (FIG. 6).

Figure 5A:
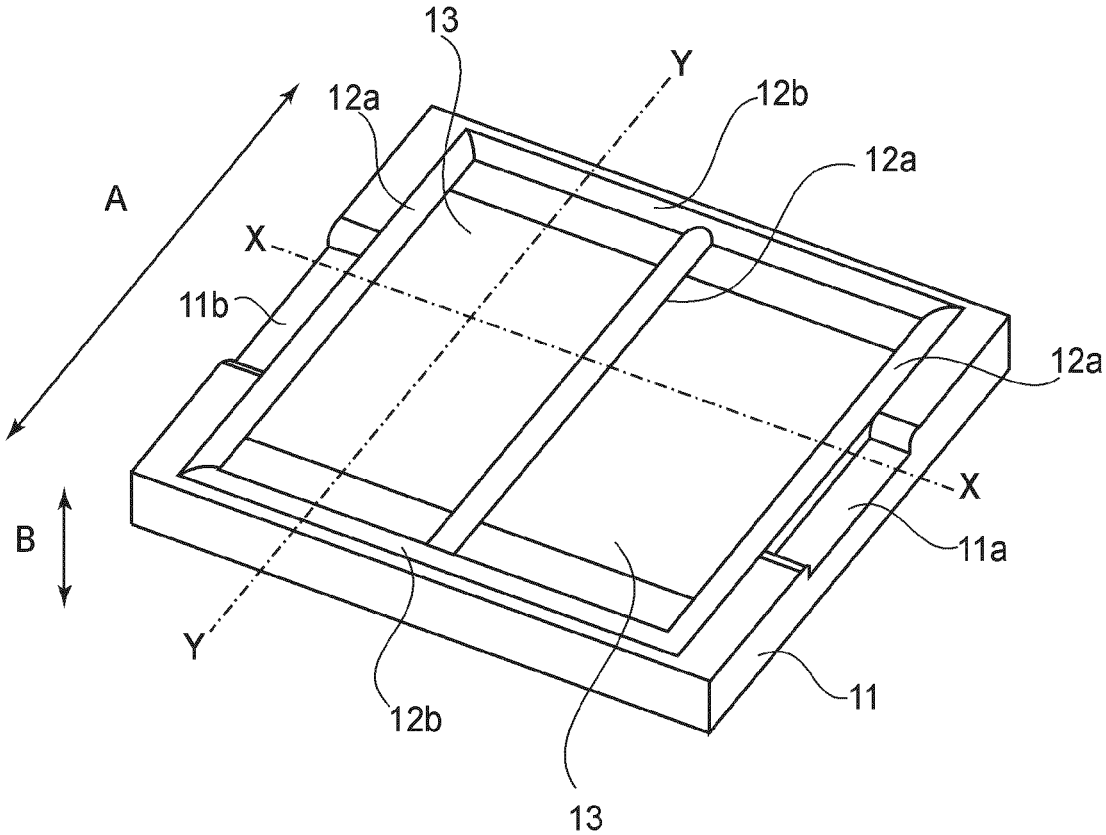
FIG. 5A is a schematic perspective view showing a liquid-absorbing member constituting the capping unit.
Figure 5B:
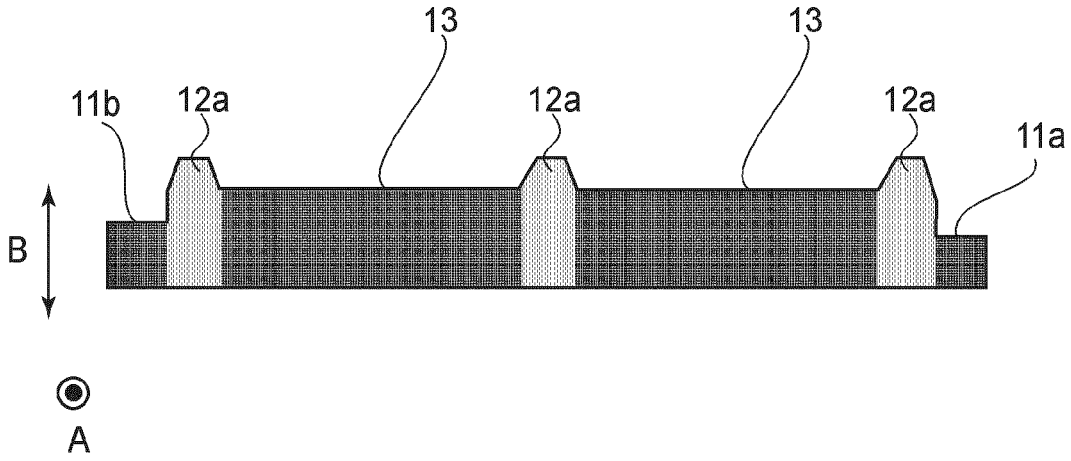
FIG. 5B is a schematic sectional view of the liquid-absorbing member taken along X-X line shown in FIG. 5A.
Figure 5C:
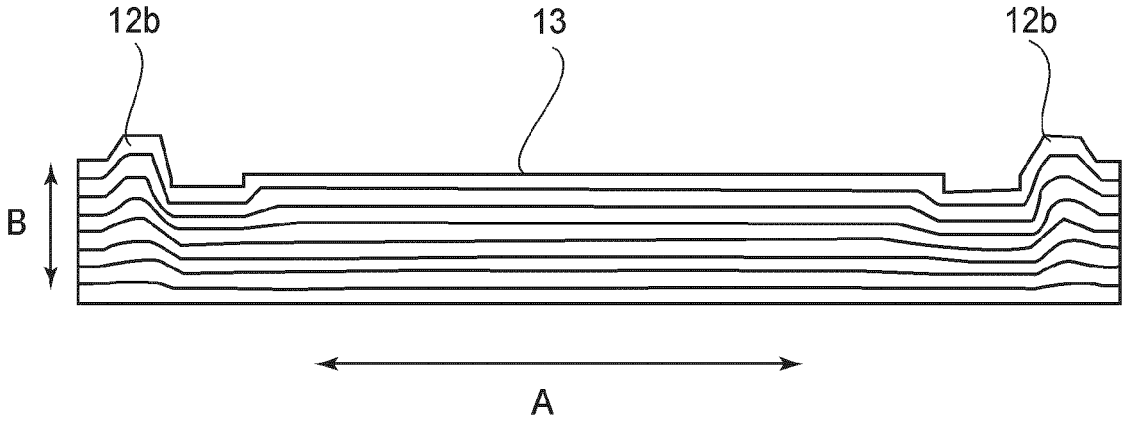
FIG. 5C is a schematic sectional view of the liquid-absorbing member taken along Y-Y line shown in FIG. 5A.

FIG. 5A is a perspective view showing the liquid-absorbing member 11, FIG. 5B is a sectional view of the liquid-absorbing member 11 taken along X-X line indicated in FIG. 5A, and FIG. 5C is a sectional view of the liquid-absorbing member 11 taken along Y-Y line indicated in FIG. 5A. Referring to FIG. 5A, the liquid-absorbing member 11 is constituted by an assembly of fibers which are arranged in a direction A and are heat-compressed in a direction B.

The liquid-absorbing member 11 is provided with the projection 12 (12*a* and 12*b*) contactable to the electric wiring tape 3 constituting the ejection outlet surface 2 and the recess 13 depressed relative to the projection 12. In a state in which the capping unit 14 is attached to the recording head 1, the projection 12 contacts the electric wiring tape 3 and the recess 13 is positioned to provide a predetermined spacing between the recess 13 and the area in which the ejection outlets 2*a* of the recording head 1 are formed.

This shape (a three-dimensional shape constituting the projection 12, the recess 13, and the like) is formed by molding a fiber lamination member with a substantially uniform fiber arrangement direction through thermal compression (thermal deformation processing). As shown in FIGS. 5A to 5C, the fiber arrangement direction is the direction of an arrow A and a lamination direction of the fiber lamination member is the direction of an arrow B. As shown in FIG. 5B (X-X sectional view), the projection 12*a* is formed along the arrangement direction of the assembly of fibers (the arrow A direction). On the other hand, as shown in FIG. 5C (Y-Y sectional view), the projection 12*b* are formed by thermal compression in a direction substantially perpendicular to the arrow A direction.

With respect to one fiber along the arrow A direction, the projection 12*a* is not bent along the arrow B direction but the projection 12*b* is bent along the arrow B direction, so that the projection 12*a* is capable of forming an accurate projection shape (a stepped shape along the arrow B direction) compared with the case of the projection 12*b*.

In FIG. 5B, the recess 13 has a larger compression ratio than the projection 12*a*, so that the recess 13 can absorb and retain a liquid in a larger amount than that of the projection 12*a*.

Further, as shown in FIG. 5A, the projections 12*a* and 12*b* contacts the ejection outlet surface 2 so as to surround the area in which the ejection outlets 2*b* are formed on the ejection outlet surface 2, so that even when a liquid leaked out of the ejection outlets during distribution flows along the ejection outlet surface 2, such a liquid is absorbed by the projections 12*a* and 12*b* of the liquid-absorbing member 11. Therefore, a possibility of leakage of the liquid to the outside of the capping unit 14 can be reduced.

Further, the liquid-absorbing member 11 is provided with depressed portions 11*a* and 11*b* at central portions of opposing two sides thereof along the arrow A direction of the fiber assembly so that these depressed portions 11*a* and 11*b* are engaged with the first and second engaging portions 24 and 31 of the capping member 6 when the liquid-absorbing member 11 is mounted on the capping member 6. The depressed portions 11*a* and 11*b* a provided along the arrow A direction of the fiber assembly, so that an accurate stepped shape is formed along the arrow B direction similarly as in the case of the above-described projection 12*a*.

As described above, by subjecting the fiber assembly to thermal compression in the arrow B direction so that the fiber assembly has the shape as shown in FIG. 5A, it is possible to accurately form a three-dimensional shape including the stepped shape.

The liquid-absorbing member 11 is held by the capping member 6 while being fixed by the first engaging portion 24, the second engaging portion 31, and the elastic structure 8. A structure in which the liquid-absorbing member is held by the capping member 6 is the capping unit 14.

FIG. 6 is a schematic perspective view for illustrating the recording head 1, and the capping unit 14 constituted by the capping member 6 and the liquid-absorbing member 11 described above.

In the case where the capping unit 14 is mounted to the recording head 1, the liquid-absorbing member 11 is pressed by the elastic structure 8 of the capping member 6 with respect to a direction toward the ejection outlet surface 2 (a direction opposite to an arrow Z direction).

As described above, the elastic structure 8 is constituted in an adjusted state, so that it is possible to protect the recording head surface with high reliability. A reference numeral 33 represents an ink injection port cap for protecting the ink injection port 5 and absorbing ink leaked from the ink injection port 5. The ink injection pot cap 33 is provided with an absorbing member 34, so that the absorbing member 34 contacts the ink injection port 5 and a part of the recording head 1 when the ink injection port cap 33 is mounted to the recording head 1. As a result, it is possible to absorb the ink leaked from the ink injection port 5.

Figure 7:
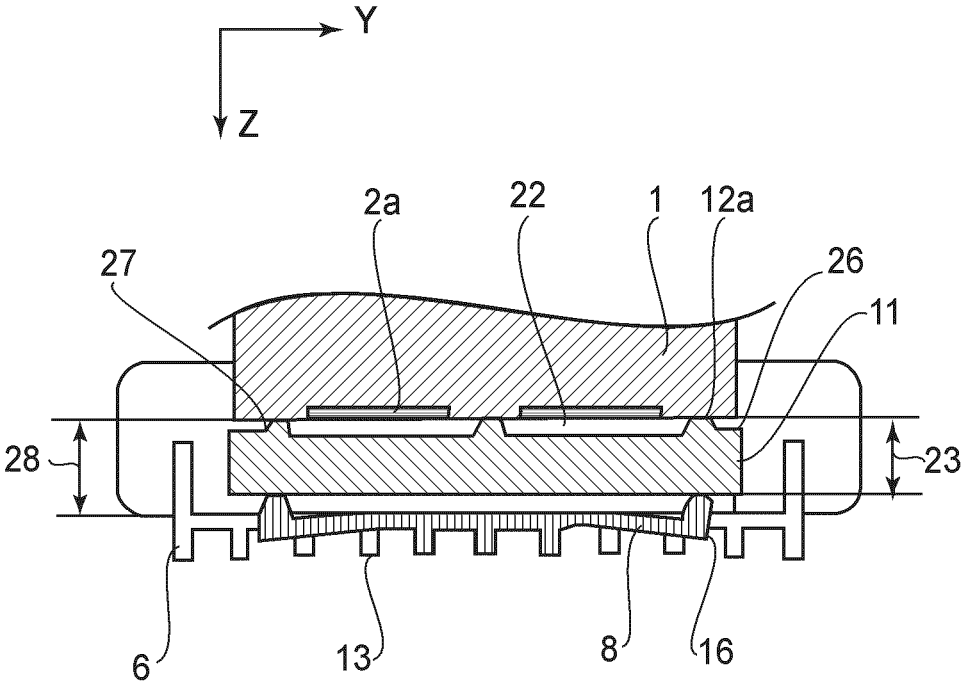
FIG. 7 is a partially enlarged sectional view showing a state in which the capping unit is mounted to the recording head.

FIG. 7 is a partially enlarged sectional view showing a state in which the capping unit 14 described above is mounted to the recording head 1. As shown in FIG. 7, a spacing 22 is created between the ejection outlet surface 2 and the recess 13. The liquid-absorbing member 11 has a thickness 23. A reference numeral 28 represents a distance between the ejection outlet surface 2 and its opposite surface of the capping member 6.

The spacing 22 was set at 0.1 mm or more and 0.7 mm or less so that the distribution ink can be absorbed by the recess 13 of the liquid-absorbing member 11 before the distribution ink becomes a large droplet. As shown in FIG. 7, in the case where impact is exerted on the capping member 6 in the state in which the liquid-absorbing member 11 is pressed against the ejection outlet surface 2 by the elastic structure 8, the recording head 1 and the liquid-absorbing member 11 are integrally displaced to elastically deform the elastic structure 8 (with respect to the arrow Z direction), so that the impact is buffered. As described above, the liquid-absorbing member 11 is subjected to the thermal deformation processing, so that when impact is exerted on the recording head 1, the liquid-absorbing member 11 has rigidity to the extent that a stress receiving from the ejection outlet surface 2 can be transmitted to the elastic structure 8. Further, the rigidity of the liquid-absorbing member 11 is made smaller than that of the ejection outlet surface 2, so that it is possible to suppress damage on the ejection outlet surface 2 when the impact is exerted on the recording head 1.

Actually, such a test that the above-constituted capping member 6 and liquid-absorbing member 11 were combined to constitute the capping unit 14 and the capping unit 14 was mounted to the recording head 1 and was caused to fall freely from a height of 150 cm so as to exert impact on the ejection outlet surface 2 was conducted. As a result, no damage occurred on a portion of the ejection outlet surface 2 (electric wiring tape 3) of the recording head 1 contacting the recording element substrate 2*a* provided with the ejection outlets 2*b* and the projection 12 of the liquid-absorbing member 11. Further, when the capping unit 14 mounted to the recording head 11 was subjected to a temperature cycle (−30° C. to 60° C.) and a reduced-pressure environment (0.5 atm) in consideration of an assumed ambient condition change in a distribution state, no ink leakage from the capping unit 14 occurred.

A capping unit identical to the capping unit 14 except that the elastic structure 8 was not provided was mounted to the recording head 1 and was subjected to a similar free fall test. As a result, there was no function of impact-buffering action by the elastic structure 8, so that the recording head 1 was damaged. Specifically, the electric wiring tape 3 was damaged at a portion contacting the projection 12 of the liquid-absorbing member 11.

Further, the capping member 6 is mounted to the recording head 1 by engaging the third engaging portion 7 with the hooking portion 9 and engaging the fourth engaging portion 15 with the hooking portion 10, so that a positional relationship therebetween is identified. Therefore, the thickness 23 of the liquid-absorbing member 11 is not particularly limited so long as the thickness 23 is within a range of achieving the impact buffering effect.

For example, the respective structures for the capping unit 14 are constituted to provide a thickness 23 of the liquid-absorbing member 11 of 5.6 mm, a spacing between the ejection outlet surface 2 and its opposite surface of the capping unit 14 of 6.6 mm, and a height of the projected portion 16 of 2 mm. In this case, when the capping unit 14 is mounted to the recording head 1, the elastic structure 8 is placed in such a state that it outwardly projects by about 1 mm but is further elastically deformable, thus retaining the impact buffering effect.

Further, in the case where the structures for the capping unit 14 are constituted in the same manner as in the case of the above-described structures except that the thickness 23 of the liquid-absorbing member 11 is changed from 5.6 mm to 6.1 mm, an amount of deformation of the elastic structure 8 is 1.5 mm but the impact buffering effect is still retained.

Further, in the case where the structures for the capping unit 14 are constituted in the same manner as in the case of the above-described structures except that the thickness 23 of the liquid-absorbing member 11 is changed from 5.6 mm to 5.1 mm, the amount of deformation of the elastic structure 8 is 0.5 mm but the impact buffering effect was still retained.

The above-described free fall test and ambient condition test were conducted with respect to three types of the constitutions described above. As a result, the recording head 1 was not damaged and no ink leakage occurred, so that the impact buffering effect of the elastic structure 8 was confirmed.

Even in the case where the elastic structure 8 is provided to the capping unit 14, when the thickness 23 of the liquid-absorbing member 11 is increased more than necessary, the elastic structure 8 cannot buffer external impact, so that excessive load is exerted from the capping member 6 on the ejection outlet surface 2 of the recording head 1 through the liquid-absorbing member 11. Further, in the case where the thickness 23 of the liquid-absorbing member 11 is excessively small, the projection 12 of the liquid-absorbing member 11 is placed in a non-contact state with the recording head 1 to increase the spacing 22, so that ink leakage occurs due to impact or ambient condition change.

As described above, the impact buffering effect cannot be achieved in the case where the elastic structure 8 is not provided.

In this embodiment, the liquid-absorbing member 11 is attached to the capping unit 14 by the first engaging portion 24 and the second engaging portion 31. This constitution has such an advantage that a user removes the capping unit 14 and thereafter can discard the capping unit 14 as it is by holding the connecting contact protecting portion 25.

Figure 8:
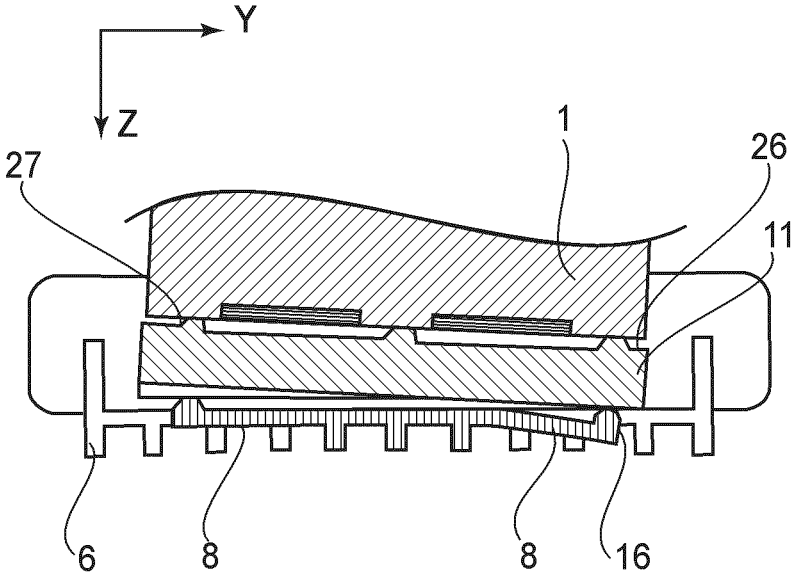
FIG. 8 is a partially enlarged sectional view showing another state in which the capping unit is mounted to the recording head.

Further, in the form of distribution, the recording head 1 can be subjected to impact by not only the free fall but also rotational drop and the impact is transmitted in various directions. Referring to FIG. 2, there can be such a situation that the liquid-absorbing member absorbs raising impact (movement in a direction opposite to the arrow Z direction) in an area 26 and depressing impact (movement in the arrow Z direction) in an area 27. FIG. 8 is a partially enlarged sectional view showing a state of deformation of the elastic structure 8 in such a situation.

As shown in FIG. 8, also in order to move the liquid-absorbing member 11 three dimensionally (so as to change positions of the areas 26 and 27 with respect to the arrow Z direction), it is preferable that the first engaging portion 24 and the second engaging portion 31 are provided at two positions located at central portions of opposite two sides of the liquid-absorbing member 11.

That is, when the engaging portions are provided at two positions, the liquid-absorbing member 11 can be stably held by the capping member 6 and it is possible to keep Z direction latitude of the liquid-absorbing member 11 with respect to the capping member 6.

Further, as shown in FIG. 2, at central portions of opposite sides of the liquid-absorbing member 11, the first engaging portion 24 and the second engaging portion 31 are provided, so that four corner portions of the liquid-absorbing member 11 where application points of the elastic structure 8 are present are moved in the Z direction with the first engaging portion 24 and the second engaging portion 31 as supporting points. For that reason, when the first engaging portion 24 and the second engaging portion 31 are provided at positions deviated from the central portions of the opposite sides of the liquid-absorbing member 11, an amount of displacement of the liquid-absorbing member 11 at each of the deviated positions is decreased, thus getting out of balance. In this case, the impact buffering effect does not come up to expectations.

Further, even in the case where a claw portion is provided at portions of the capping member 6 corresponding to midpoints of all the four sides of the liquid-absorbing member 11, the amount of displacement of the liquid-absorbing member 11 is decreased. For example, a capping member 6 provided with four engaging portions by additionally providing two engaging portions to the side surface 25 side and the fourth engaging portion 15 side in addition to the first and second engaging portions 24 and 31 shown in FIG. 6 is considered. When a capping unit 14 using the capping member 6 having such a constitution is mounted to the recording head 1 and subjected to impact, there is no problem in a drop test from a height of 120 cm but cracking of the capping member 6 occurs in a drop test from a height of 150 cm. This may be considered that the impact cannot be absorbed only be the elastic structure 8 but is exerted on the capping member 6 itself.

As described above, in the case of utilizing the first and second engaging portions 24 and 31 in order to hold the liquid-absorbing member 11, their arrangement is an important factor. However, even in the case where the first and second engaging portions 24 and 31 are not provided, when the capping unit 14 is attached to the recording head 1, it is possible to bring the projection 12 of the liquid-absorbing member 11 into contact with the electric wiring tape 3. As a result, the liquid-absorbing member 11 is sandwiched between the ejection outlet surface 2 and the elastic structure 8.

Actually, when a similar drop test was performed by using the recording head 1 to which a capping unit 14 prepared by removing the first and second engaging portions 24 and 31 from the capping member 6 and then mounting the liquid-absorbing member 11 on the capping member 6 was mounted, damage on the recording head 1 did not occur. Further, the recording head 1 was similarly subjected to the above-described distribution ambient condition test but ink leakage did not occur.

The elastic structure 8 is only required to create such a state that load is exerted thereon substantially uniformly when the liquid-absorbing member 11 is sandwiched between the capping member 6 and the recording head 1. Uniform load application is easily realized by providing the elastic structure 8 at a plurality of positions. Further, also in order to hold and move the liquid-absorbing member in a balanced manner, it is preferable that the elastic structure 8 is equidistantly disposed at positions from the center of the side surface 21 of the capping member 6 toward the four corners of the side surface 21.

Figure 9:
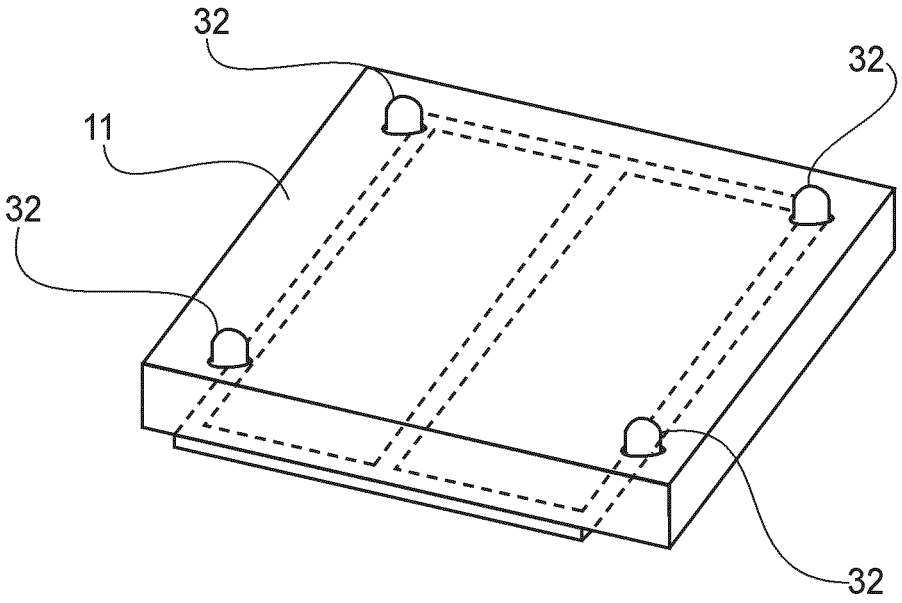
FIG. 9 is a schematic perspective view showing another constitutional example of the liquid-absorbing member.

The elastic structure 8 is described in the form such that the elastic structure 8 is provided with the projected portions 16 integrally formed with the elastic structure 8. However, such a form is preferred but the present invention is not limited thereto. For example, as shown in FIG. 9, an elastic structure 8 which are not provided with the projected portions 16 is formed and projected portions 32 may be provided at positions, corresponding to the application points of the elastic structure 8, on a surface of the liquid-absorbing member 11 opposing the capping member 6 (i.e., a surface opposite from the surface opposing the ejection outlet surface 2).

The liquid-absorbing member 11 is formed of compressed fibers of polypropylene identical to the material for the capping member 6. However, the material is not limited to polypropylene but may also be, e.g., polyurethane or polyethylene terephthalate. By forming the capping member 6 and the liquid-absorbing member 11 of the same material, recycling of the material is facilitated.

As described hereinabove, according to the capping unit to which the present invention is applied and the recording head to which the capping unit is mounted, even in the case where the recording head is accidentally dropped so as to exert impact on the ejection outlet surface provided with the ejection outlets, the elastic structure is deformed to alleviate the impact.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application Nos. 251887/2007 filed Sep. 27, 2007, and 218458/2008 filed Aug. 27, 2008, which are hereby incorporated by reference.

What is claimed is:

1. A capping unit detachably mountable to an ink jet recording head, the ink jet recording head having an ejection outlet surface provided with ejection outlets for ejecting ink, the capping unit comprising:

a liquid-absorbing member provided with a projection contactable to a periphery of an area, in which the ejection outlets are formed, on the ejection outlet surface so as to form a gap between the area and the liquid-absorbing member; and a capping member including (i) an elastic portion for contacting a rear surface opposite from a surface on which the projection of the liquid-absorbing member is formed to press the liquid-absorbing member against the ejection outlet surface, (ii) a first engaging portion which is provided on a first surface so as to cover an electrical connecting terminal formed on the ink jet recording head, the first engaging portion engaging with a first ink jet head engaging portion formed on the ink jet recording head to maintain a relative position between the capping member and the ink jet recording head against an elastic force of the elastic portion, and (iii) a second engaging portion which is provided on a second surface, the second engaging portion engaging with a second ink jet head engaging portion formed on the ink jet recording head to maintain a relative position between the capping member and the ink jet recording head against the elastic force of the elastic portion, wherein an interval between the first engaging portion and the liquid-absorbing member is larger than an interval between the second engaging portion and the liquid-absorbing member.

2. A unit according to claim 1, wherein the capping member is partially cut to constitute the elastic portion.

3. A unit according to claim 2, wherein the elastic portion is provided with a projected portion which is integrally formed with the elastic portion and is contactable with the rear surface.

4. A unit according to claim 2, wherein the liquid-absorbing member is provided with a projected portion which is integrally formed with the liquid-absorbing member and is contactable with the rear surface.

5. A unit according to claim 2, wherein the liquid-absorbing member substantially has a rectangular shape.

6. A unit according to claim 5, wherein the capping member includes two third engaging portions for attaching the liquid-absorbing member to the capping member, and wherein the two third engaging portions are provided at positions corresponding to central portions of opposing two sides of four sides of the rectangular liquid-absorbing member.

7. A unit according to claim 6, wherein the rectangular liquid-absorbing member is provided with a recessed portion engageable with the third engaging portions.

8. A unit according to claim 1, wherein the liquid-absorbing member includes an assembly of fibers arranged in a direction perpendicular to a thickness direction thereof.

9. A unit according to claim 8, wherein the liquid-absorbing member is formed by being compressed in the thickness direction through thermal deformation processing.

10. A unit according to claim 1, wherein the capping member and said liquid-absorbing member are formed of the same material.

11. An ink jet recording head unit, comprising:

an ink jet recording head having an electrical connecting terminal, and an ejection outlet surface provided with ejection outlets for ejecting ink and accommodating therein a liquid; and a capping unit mounted to the ink jet recording head during distribution, wherein the capping unit includes (i) a liquid-absorbing member provided with a projection for forming a gap between an area, in which the ejection outlets are formed, on the ejection outlet surface and the liquid-absorbing member, the projection contacting a periphery of the area on the ejection outlet surface, and (ii) a capping member including (i) an elastic portion for contacting a rear surface opposite from a surface on which the projection of the liquid-absorbing member is formed to press the liquid-absorbing member against the ejection outlet surface, (ii) a first engaging portion which is provided on a first surface so as to cover the electrical connecting terminal, the first engaging portion engaging with a first ink jet head engaging portion formed on the ink jet recording head to maintain a relative position between the capping member and the ink jet recording head against an elastic force of the elastic portion, and (iii) a second engaging portion which is provided on a second surface, the second engaging portion engaging with a second inkjet head engaging portion formed on the ink jet recording head to maintain a relative position between the capping member and the ink jet recording head against the elastic force of the elastic portion, wherein an interval between the first engaging portion and the liquid-absorbing member is larger than an interval between the second engaging portion and the liquid-absorbing member.

* * * * *